US010870043B2

(12) United States Patent
Cooper

(10) Patent No.: US 10,870,043 B2
(45) Date of Patent: Dec. 22, 2020

(54) GOLF TEE WITH REDUCED FRICTION

(71) Applicant: Jack Cooper, Palos Hills, IL (US)

(72) Inventor: Jack Cooper, Palos Hills, IL (US)

( * ) Notice: Subject to any disclaimer, the term of this patent is extended or adjusted under 35 U.S.C. 154(b) by 0 days.

(21) Appl. No.: 16/419,812

(22) Filed: May 22, 2019

(65) Prior Publication Data

US 2020/0368593 A1 Nov. 26, 2020

(51) Int. Cl.
*A63B 57/10* (2015.01)

(52) U.S. Cl.
CPC ..... *A63B 57/10* (2015.10)

(58) Field of Classification Search
CPC ..... A63F 57/10; A63F 57/13; A63B 57/13; A63B 57/19; A63B 57/15; A63B 57/10
USPC ..... D21/717
See application file for complete search history.

(56) References Cited

U.S. PATENT DOCUMENTS 1,671,813 A * 5/1928 Clarke ..... A63B 57/10 473/403
1,699,934 A 1/1929 Warner
1,783,211 A * 12/1930 Baldwin ..... A63B 57/10 473/257
2,455,705 A 12/1948 Seager
3,506,263 A 4/1970 Arridge
4,106,772 A * 8/1978 Krawagna ..... A63B 57/10 473/278
4,392,278 A * 7/1983 Mugglestone ..... F16B 19/004 24/614
4,783,077 A 11/1988 Lemon
4,787,637 A 11/1988 Lima et al.
5,356,146 A 10/1994 Blosser
5,383,668 A * 1/1995 Andrikian ..... A63B 57/19 473/132
5,505,444 A * 4/1996 Bouclin, Jr. ..... A63B 57/10 473/401
D382,929 S * 8/1997 DeBlieux ..... D21/717
5,885,167 A * 3/1999 St. Martin ..... A63B 57/10 473/278
6,152,837 A * 11/2000 Reid ..... A63B 57/15 473/387
6,344,003 B1 * 2/2002 Choung ..... A63B 57/10 473/387
6,482,111 B1 * 11/2002 Jofferion ..... A63B 57/10 473/386

(Continued)

FOREIGN PATENT DOCUMENTS

GB 1036728 A * 7/1966 ..... B65D 39/0023
KR 300890797.0000 1/2017
WO WO-9423806 A1 * 10/1994 ..... A63B 57/15

*Primary Examiner* — Steven B Wong
(74) *Attorney, Agent, or Firm* — Fishman & Associates, LLC.

(57) ABSTRACT

The present invention pertains to a golf tee comprising a stem portion and a top portion connected to the stem portion, the top portion includes an upper surface that opposes the stem and having a convex shape, free of an adhesive layer or material that anchors the ball on the upper surface against uneven ground. The golf tee minimizes friction and other impeding forces between the tee and the ball by reducing an area of contact between the tee and the ball, while preventing the player from installing the golf tee other than vertically into the ground, or horizontal to the Earth's surface, thereby preventing the golf player from having to alter his or her posture and stroke according to the mounting of the ball.

16 Claims, 16 Drawing Sheets

(56) References Cited

U.S. PATENT DOCUMENTS

| | | | | |
|---|---|---|---|---|
| D486,538 | S | 2/2004 | Cardarelli | |
| D492,743 | S | 7/2004 | Boyarko | |
| 6,764,262 | B1 * | 7/2004 | Hargis | F16B 35/06 411/369 |
| 7,338,394 | B2 * | 3/2008 | Harris | A63B 57/19 473/387 |
| D603,004 | S | 10/2009 | Chudy | |
| 8,029,387 | B2 * | 10/2011 | Breton | A63B 57/10 473/387 |
| D657,431 | S | 4/2012 | Chilton | |
| 9,610,904 | B2 * | 4/2017 | Huelke | B60R 13/0206 |
| D789,468 | S | 6/2017 | McMahan, II | |
| 10,569,148 | B2 * | 2/2020 | Gauvin | A63B 57/12 |
| 2002/0198066 | A1 * | 12/2002 | Salsman | A63B 57/10 473/387 |
| 2003/0228939 | A1 * | 12/2003 | Sato | A63B 57/10 473/387 |
| 2005/0070379 | A1 | 3/2005 | Gilmour | |
| 2005/0148410 | A1 * | 7/2005 | DeLisle | A63B 57/10 473/387 |
| 2008/0234072 | A1 * | 9/2008 | Seaman | A63B 57/10 473/397 |
| 2010/0216576 | A1 | 8/2010 | Sanders | |
| 2012/0231900 | A1 * | 9/2012 | Kilby | A63B 69/3623 473/387 |
| 2013/0040761 | A1 | 2/2013 | Costantini et al. | |
| 2014/0031146 | A1 * | 1/2014 | Kelley | A63B 57/10 473/400 |
| 2014/0299335 | A1 * | 10/2014 | Stelin | A01L 7/10 168/23 |
| 2019/0072124 | A1 * | 3/2019 | Pawlak | F16B 25/0031 |
| 2020/0030674 | A1 * | 1/2020 | Rice | A63B 57/10 |

* cited by examiner

GOLF TEE WITH REDUCED FRICTION

FIELD OF THE INVENTION

This invention relates to a golf tee that minimizes the forces of friction and shear between the golf tee and the golf ball when the ball is struck by a golf club, thereby maximizing the transfer of energy and momentum from the golf club head to the ball, while improving posture and swing of the golfer by requiring that the tee be planted in the ground in a leveled manner.

BACKGROUND OF THE INVENTION

When playing the game of golf, it is usual to hit the ball from a golf tee. The purpose of teeing the golf ball is to raise and support the golf ball off of the ground when driving or stroking the golf ball with a golf club. A golf tee is used in playing the game of golf and in practicing golf, especially on golf ball driving ranges and the like.

In most golf tee designs, the top of the golf tee is a cup, or a concave surface such that it is entirely in a direct contact with the convex curvature of an outer surface of the golf ball. Such direct contact creates a significant friction and other impeding forces when the golf ball is struck. Specifically, when the ball is placed in the concave surface of the tee, the front lip of the tee impedes the ball's trajectory and spin, causing a significant amount of energy from the golf club head to be transferred to the tee and to ground instead of to the ball. Furthermore, the ball can be retained by the tee even if the tee is inserted in the ground at an angle with the vertical, causing the golf player to adapt his posture and swing accordingly.

As illustrated in FIG. 1, because the top surface 150 of tee 100 has a concavity that matches the convex curvature of an outer surface of golf ball 200, golf ball 200 can be stably arranged on the top concave surface 150 of tee 100, even when the axis T of tee 100 is inserted at a substantially large angle $\alpha$ with respect to the vertical V. In other words, and as per FIG. 1, it is possible to have the golf ball 200 stably arranged on top portion 120 of tee 100, even though stem 110 is inserted into ground 300 to form a substantial angle $\alpha$ with respect to vertical V. Such a design for tee 100 allows for a wide range of angles $\alpha$ that the axis T of tee 100 can vary from the vertical V and still stably retain golf ball 200 on top thereof. This results in the golf player having to adopt varying postures and swings depending on angle $\alpha$.

Because the top concave surface 150 of tee 100 has a curvature that is similar to a curvature of an outer surface of golf ball 200, over 90% of concave surface 150 is in direct contact with golf ball 200. Furthermore, lip 132 of tee 100 creates friction, impedance and shear between golf ball 200 and tee 100 when a user strikes surface 830 of head 820 of club 800 with ball 200. Therefore, there is a concomitant reduction in kinetic and rotational energy transferred to the ball 200 by club 800 due to the tee 100.

Many attempts have been made to improve upon the design of a golf tee. U.S. Pat. Nos. 5,683,313 and 5,413,330 to Disco et al. discloses vented golf tees that reduce suction between the top surface of the golf tee and the golf ball upon impact with a club head. The golf tee designs in the Disco et al. patents require that a significantly large portion of the golf ball be in contact with the tee, resulting in a concomitant amount of friction between the golf ball and the tee. Another drawback of the tees of the Disco et al. patents is that the golf tees of the Disco et al. patents need to be inserted into the ground at an angle of about 30 degrees with respect to the vertical, forcing the golf player to adapt his or her posture and swing accordingly. By requiring the golf player to insert the tees of the Disco et al. patents into the ground at an angle, wide variations in the angle that the tee is actually inserted into the ground occur due to human error, again causing an inconsistency in swing and posture on the part of the golf player.

In U.S. Pat. No. 5,505,444 to Bouclin, Jr discloses a flat head tee design having an adhesive material that anchors the ball from rolling off the tee. The adhesive force negates any benefit from the reduced contact surface area, as the adhesive force from the adhesive layer on the golf ball will have a very high coefficient of static friction with the golf ball, which in turn reduces the amount of energy that can be transferred to the golf ball from the head of the golf club. The adhesive in Bouclin is a required feature to allow the ball to be stably planted thereon, because the upper surface of the tee in FIG. 4 of Bouclin, Jr is smaller than the size of a golf ball, resulting in a deep rate of change of slope on the upper surface of the tee. Furthermore, Bouclin, Jr also fails to establish linear and elevated pointers and paths for strike.

U.S. Pat. No. 6,004,228 to Adam discloses a vented angular golf tee that contains three or more studs for eliminating the suction between the ball and the tee. However, Adam's tee does not result in minimal frictional, shearing and impeding forces between the ball and the tee as compared to the conventional tee 100 of FIG. 1.

Other examples include U.S. Pat. No. 2,455,705 to Seager which discloses a golf tee having a downwardly tapering stem with a plurality of ribs arranged in equidistantly spaced relationship about the stem. Each top end of the ribs extends above the top of the stem and its surface is inclined downwardly toward the stem so that the extreme outer edge thereof constitutes the ball-supporting means on which the golf ball is positioned. When a golf ball is positioned on the tee, it will be out of contact and in spaced relationship with the top of the stem. Similar structures are shown in U.S. Pat. Nos. 1,658,226; 7,604,554; D695,860; D789,468; and British Patent No. 445026A.

U.S. Pat. No. 4,787,637 to Lima et al. includes a golf tee having a pair of ball-supporting structures spaced apart by a flight alignment slot. The structures have downwardly inclined surfaces to position a ball atop a graphite insert. Similarly, Korean registration 300890797.0000 to Kim also teaches a golf tee having a pair of flight alignment structures spaced-apart from each other and a shock absorber at one end of the tee. Once again, the upper surface Kim's tee is a downwardly inclined concave surface. As a result, the stem of this tee can stably support a golf ball even though the stem forms a substantial angle $\alpha$ with the vertical V, and significant friction between the ball and the tee may still be present.

The prior art does not address the need for minimizing frictional and other impeding forces between the tee and the golf ball, or the need for providing for a consistent planting of the tee in the ground.

Therefore, there is a need for minimizing forces associated with the tee that act to negate the energy transferred to the ball from the golf club at impact. Further, it is desirable to prevent the golfer from having to change his or her posture due to the differing angles the tee is planted in the ground.

There is also a need for an improved golf tee design and method of using that is directed to the leisure golfer niche where elevational and directional aids are incorporated into the design.

SUMMARY OF THE INVENTION

The present invention is directed towards a golf tee that includes 1) a stem portion having a pointed proximal end and a distal end opposing the proximal end; and 2) a top portion includes an upper surface opposing the stem, wherein the top portion connected to the distal end of the stem portion, and the upper surface has a convex shape and is free of an adhesive layer. The upper surface optionally includes removable ramps for directional and elevational aid and/or a removable backstop for anchoring the golf ball on the upper surface. The upper convex surface has a front edge that opposes a back edge such that the front edge is spaced apart from the back edge by a length of the upper surface. The upper surface further including a center point at an apex of the upper surface, the center point is arranged between the front and back edges, and when the stem portion is inserted into the ground in an orthogonal manner such that the stem portion extends vertically and is parallel to the direction of gravity, or horizontal (i.e. leveling) with the Earth's surface, to enable the golf ball stably rests on the center point of the upper surface.

The present invention is also directed towards a golf tee design that has less contact area with the golf ball and has reduced friction and impedance with the golf ball so that more kinetic and rotational energy may be delivered to the golf ball upon being hit with a golf club, while at the same time preventing the player from installing the golf tee into the ground at an angle with the vertical, thereby preventing the golf player from having to alter his or her posture and stroke according to the mounting of the tee.

The present invention is also directed towards a method of using the novel golf tee, the method including 1) providing the golf tee that includes a stem portion having a pointed proximal end and a distal end opposing the proximal end and a top portion including an upper surface that faces away from the stem portion, the distal end of the stem portion is attached to the top portion, the upper surface of the top portion is convex throughout and having an apex or center point, the upper surface is free of adhesive or material that anchors the ball against an uneven ground; 2) inserting the proximal end of the stem portion into ground, placing a golf ball on the center point of the convex upper surface and readjusting an angle of the stem with a vertical, such that the apex is horizontal or leveling with the Earth's surface, to enable the golf ball to stay on the center point of the convex upper surface.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

The present invention is directed towards a golf tee that includes 1) a stem portion having a pointed proximal end and a distal end opposing the proximal end; and 2) a top portion includes an upper surface opposing the stem, wherein the top portion connected to the distal end of the stem portion, and the upper surface has a convex shape and is free of an adhesive layer. The upper surface optionally includes removable ramps for directional and elevational aid and/or a removable backstop for anchoring the golf ball on the upper surface. The upper convex surface has a front edge that opposes a back edge such that the front edge is spaced apart from the back edge by a length of the upper surface. The upper surface further including a center point at an apex of the upper surface, the center point is arranged between the front and back edges, and when the stem portion is inserted into the ground in an orthogonal manner such that the stem portion extends vertically and is parallel to the direction of gravity, or horizontal (i.e. leveling) with the Earth's surface, to enable the golf ball stably rests on the center point of the upper surface.

The present invention minimizes the effect of forces associated between the tee and the ball results in greater kinetic and rotational energy being delivered to the ball, resulting in longer flight distances and more initial ball spin due to the club head acting on the ball. These benefits are a primary object of the invention and are especially desirable for the long shot, where the ability to advance the ball takes precedence. In addition, the short shot where maximum backspin helps to stop the ball quickly on the putting green is improved.

The present invention is also directed towards a golf tee design that has less contact area with the golf ball and has reduced friction and impedance with the golf ball so that more kinetic and rotational energy may be delivered to the golf ball upon being hit with a golf club, while at the same time preventing the player from installing the golf tee into the ground at an angle with the vertical such that the apex is horizontal or leveling with the Earth's surface, thereby preventing the golf player from having to alter his or her posture and stroke according to the mounting of the tee.

Without wishing to be bound by theory, the present invention minimizes the friction between the tee and the ball such that greater kinetic and rotational energy is delivered to the golf ball, resulting in longer flight distances and more initial ball spin due to the club head acting on the golf ball. These benefits are especially desirable for the long shot, where the ability to advance the ball takes precedence. In addition, the short shot where maximum backspin helps to stop the ball quickly on the putting green is improved.

Figure 2:
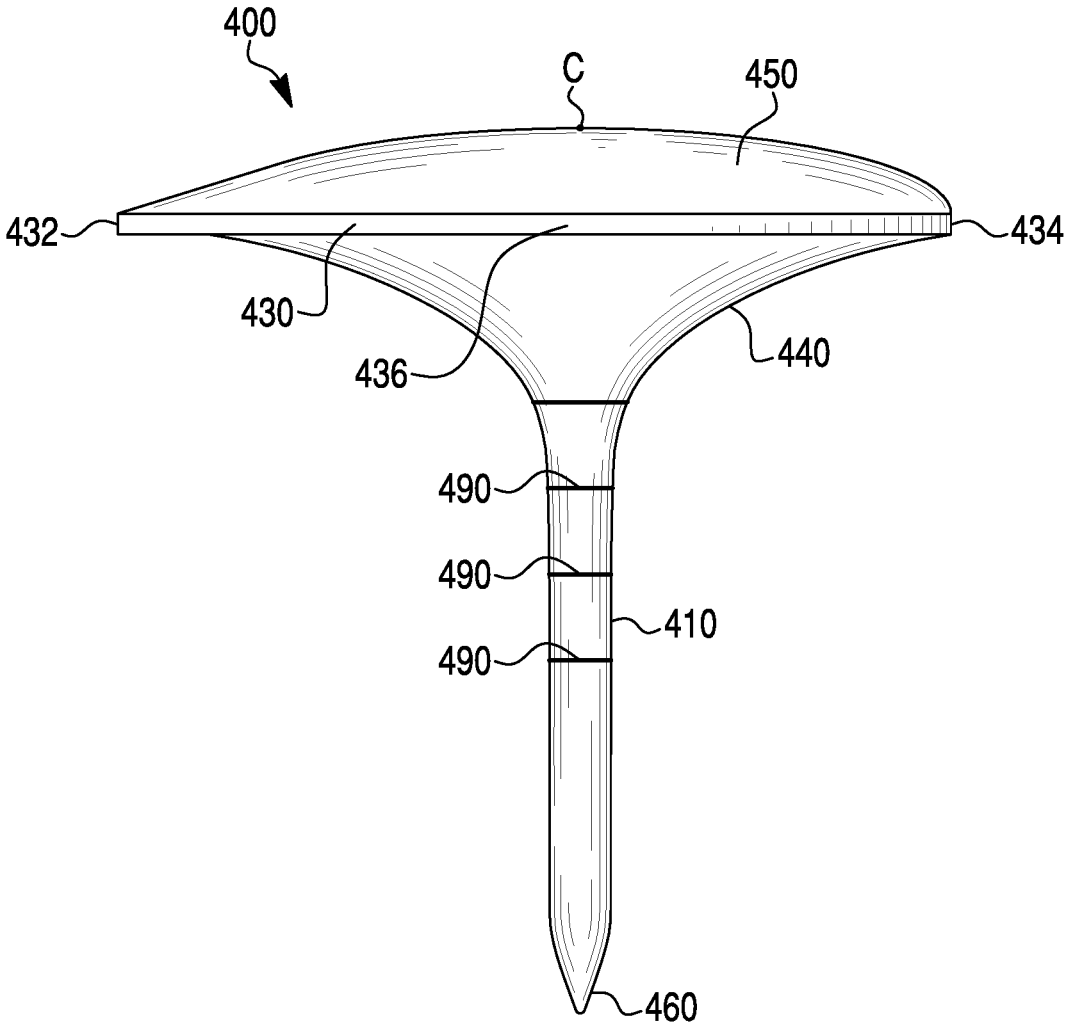
FIG. 2 is a left side view of the golf tee according to a first embodiment of the present invention.

Referring now to FIG. 2, FIG. 2 illustrates a left side view of the novel golf tee 400 according to a first embodiment of the present invention. As illustrated in FIG. 2, golf tee 400 includes a stem portion 410 attached to a top portion 420. At a proximal end of stem portion is a sharp tip 460 to allow for easy insertion into ground, while the distal and opposite end of stem portion 410 is connected to top portion 420. Between the proximal and the distal ends of stem portion 410 are a plurality of markings 490 that encircle stem portion 410. Markings 490 are preferably recesses in the side wall of stem portion 410, to provide visual aid the leisure golf player of the depth in which the stem portion 410 is inserted into ground during use.

As illustrated in FIG. 2, top portion 420 includes an edge 430 arranged between a top surface 450 and a bottom surface 440. Bottom surface 440 connects to a distal end of stem portion 410, while top surface 450 is convex throughout.

Top portion 420 can be formed integrally with stem portion 410 as a single integrated monolithic structure, and golf tee 400 can be made out of any suitable bulk material, such as plastic, wood, metal or any mixture thereof. The entire exterior of tee 400, including top convex surface 450, can be made of said bulk material, or could instead include a cured paint, acrylic or cured resin exterior for decoration or other purposes. Alternatively, the novel tee 400 can include a polyurethane or polystyrene foam core and a polyester or epoxy resin coating shell.

The top convex surface 450 where the ball 200 rests thereon is made out of a material that does not produce a significant friction with the golf ball 200. It is to be appreciated that the top convex surface 450 of the present invention is made of a non-adhesive material. In other words, it is preferred that the coefficient of static friction between the golf ball 200 and the top convex surface 450 be minimal, so that an efficient transfer of energy between a swinging golf club and ball 200 is achieved.

Figure 7:
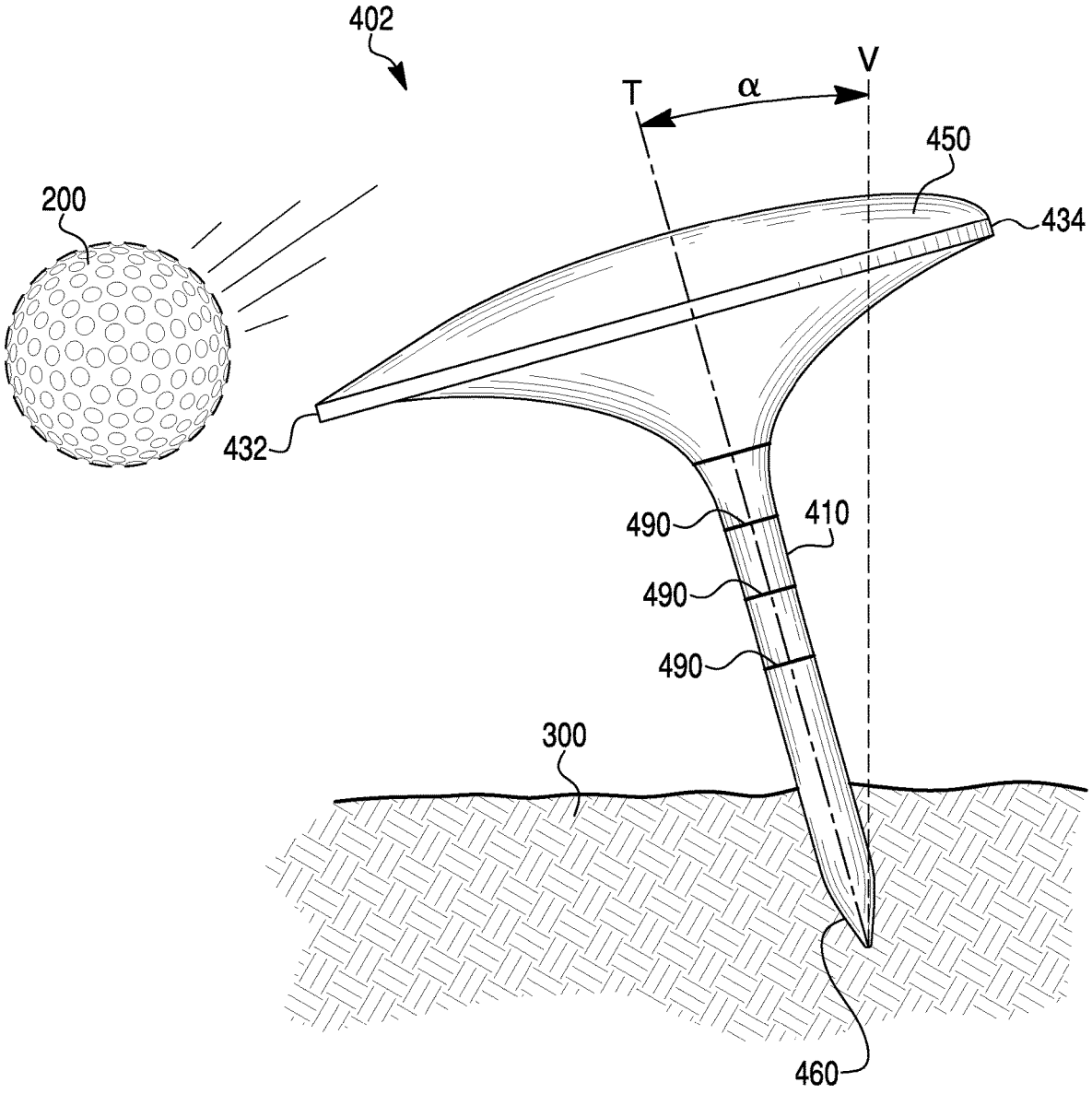
FIG. 7 describes a method of using the golf tee according to the first embodiment of the present invention.

As also illustrated in FIG. 2, edge 430 of top portion 420 includes a front edge 432 opposite back edge 434 and a left edge 436 opposite right edge 438. Also illustrated on the convex upper surface 450 of the tee 400 of FIG. 2 is an apex or center point C. When stem portion 410 is arranged vertically with respect to ground such that the stem portion 410 is parallel to the force of gravity or horizontal/leveling to the Earth's surface, and ball 200 is placed at center point C of top convex surface 450, ball 200 will stably rest on convex top surface 450. Accordingly, top portion 420 and convex surface 450 are dimensionally larger than golf ball so that changes in slope from point to point on convex surface 450 are subtle and gradual so that it is much easier for the golf player to place ball 200 on center point C and not have ball 200 roll off tee 400 as in FIG. 7.

Figure 3A:
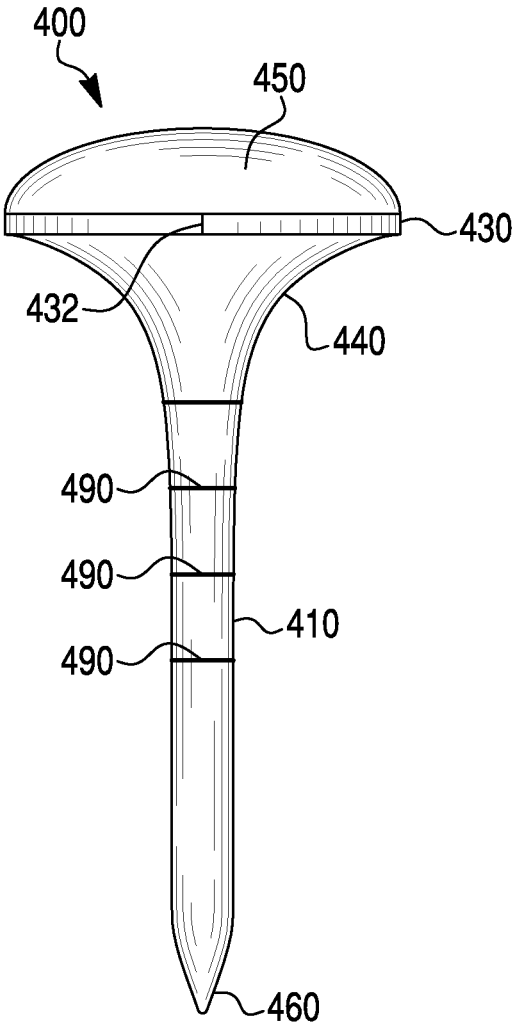
FIG. 3A is a front side view of the golf tee of FIG. 2 according to the first embodiment of the present invention.
Figure 3B:
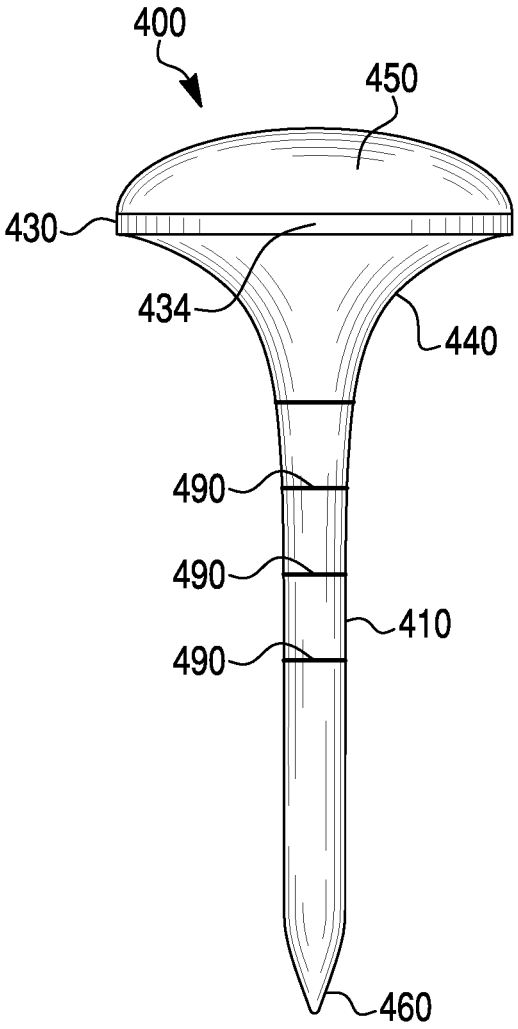
FIG. 3B is a rear side view of the golf tee of FIG. 2 according to the first embodiment of the present invention.

FIGS. 3A and 3B are front side and back side views respectively of the novel golf tee 400 of FIG. 2. As illustrated in FIGS. 3A and 3B, front edge 432 forms a sharp point at the front of tee 400, while back edge 434 is rounded and smooth. Unlike tee 100 of FIG. 1, front edge 432 provides the leisure niche of golfers a directional aid. It is to be appreciated that the present invention is in no way so limited to the arrangements of FIGS. 3A and 3B, as it is possible to have both front edge 432 and back edge 434 be curved, smooth and round and not have any pointed edges and still be within the scope of the present invention.

Figure 4A:
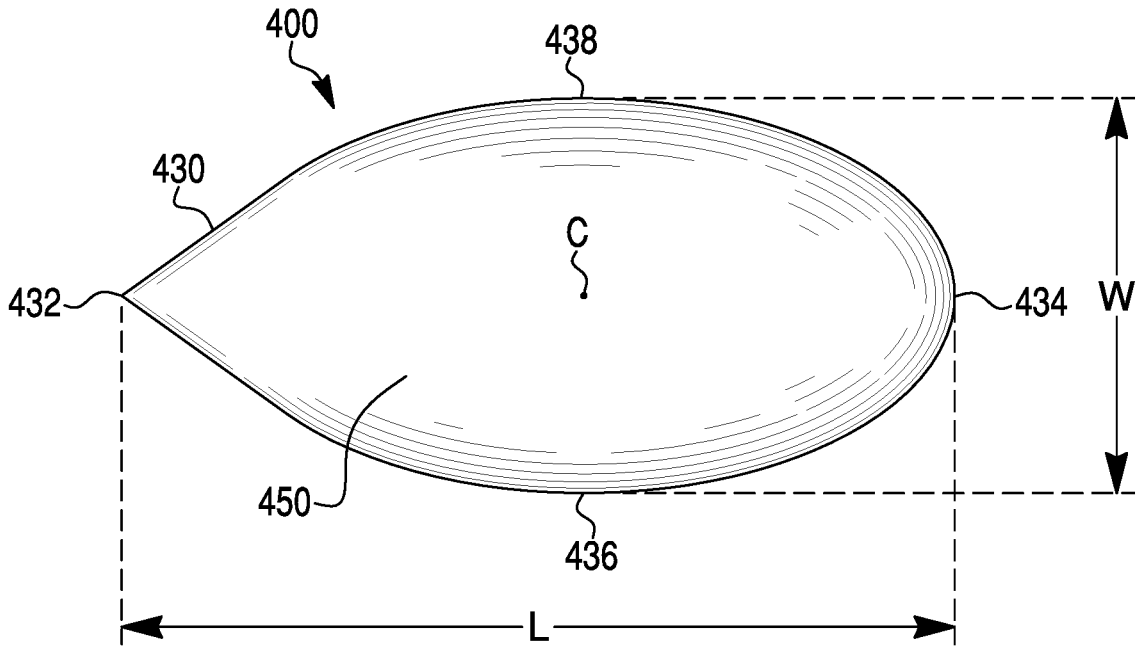
FIG. 4A is a top view of a golf tee according to the first embodiment of the present invention.
Figure 4B:
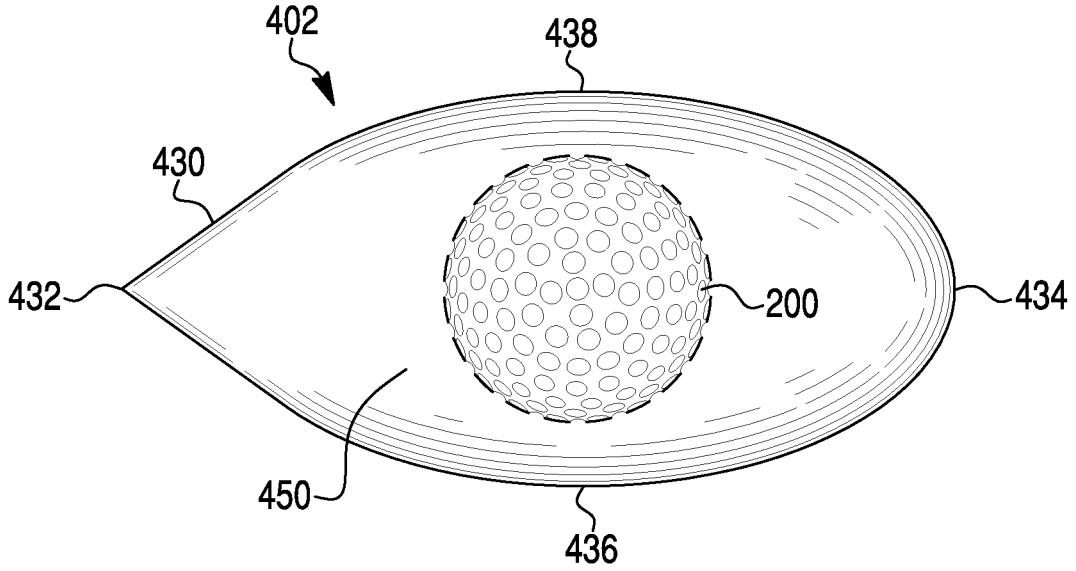
FIG. 4B is a top view of a golf tee arrangement using the golf tee of FIG. 4A.

FIG. 4A illustrates a top view of golf tee 400 according to the first embodiment of the present invention absent golf ball 200 and FIG. 4B illustrates a top view of golf tee arrangement 402 with golf ball 200 arranged on center point C of top convex surface 450 of tee 400. As shown in FIGS. 4A and 4B, the novel golf tee 400 has a built-in directional indicator that points to the direction ball 200 is to travel upon being struck by a golf club. Specifically, golf ball 200 is to travel in a direction of front edge 432, and club swing progresses from back edge 434 to front edge 432 while striking ball 200 therebetween.

Also illustrated in FIGS. 4A and 4B is a length L of top portion 420 which connects front edge 432 to back edge 434, and a width W of top portion 420 which connects left and right edges 436 and 438. The width W of top portion 420 is greater than the diameter (typically 1.68 inches) of golf ball 200, but preferably less than 3 inches, and the length L is about 1.5 times or more than the width W. Therefore, when the golf player plants the stem portion 420 into the ground having the golf ball 200 rests on the apex or center point C of top surface 450, the left and right edges 436, and 438 of top surface 450 are not obscured by golf ball 200. Without wishing to be bound by theory, since the area of the top surface 450 of tee 400 is larger than the area of the golf ball 200, the changes in slope of different portions of top surface 450 with respect to the horizontal change is gradual from point to point on top surface, so that it is convenient for the golf player to find the apex or center point C of top surface 450 upon which to plant the ball 200 thereon.

It is to be appreciated that when a golf player swings his or her golf club to hit the ball 200, the direction in which the head of the golf club moves is parallel to the length L direction of the top portion 420 of tee 400, and the golf club head travels from back edge 434 to front edge 432 while striking ball 200 therebetween. As a result, golf ball 200 is launched at front edge 432. Since the top surface 450 is convex and mates with a convex outer surface of ball 200, an area of contact is minimized to thereby reduce a coefficient friction between golf ball 200 and top convex surface 450, and edge 430 of the convex surface 450 does not interfere with the ball as compared with the arrangement of FIG. 1.

Figure 5:
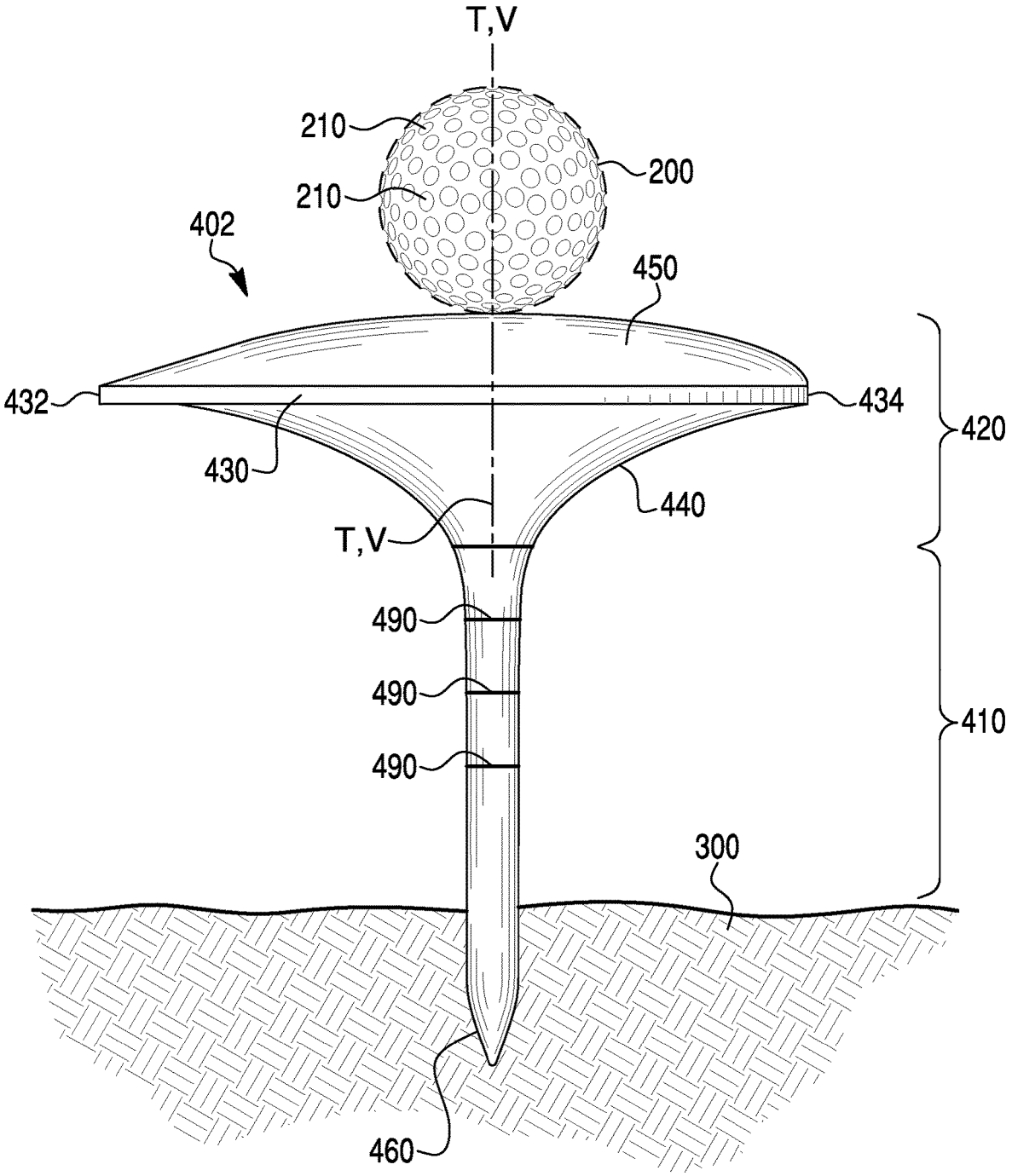
FIG. 5 is a left side view of a golf tee arrangement using the golf tee according to the first embodiment of the present invention.

FIG. 5 illustrates a left side view of golf tee arrangement 402 according to the first embodiment of the present invention. The arrangement 402 of FIG. 5 is analogous to the golf tee 400 illustrated in FIG. 2, except that tip 460 of stem 410 is inserted into and is horizontal to the ground 300, such that golf ball 200 is stably arranged on top of concave surface 450. Specifically, the axis T of stem portion 410 is arranged vertically with respect to ground 300 in a direction that corresponds to the direction of Earth's gravity, or horizontal to Earth's surface, and not at an angle α with respect to the vertical V, golf ball 200 is stably arranged on apex or center point C of convex surface 450. If stem 410 were inserted into ground 300 at an angle α with respect to the vertical V as in FIG. 7, ball 200 would roll off convex surface 450. Consequently, the golf tee 400 of the present invention prevents stem 410 from being incorrectly inserted into, or unleveled with the ground, and is therefore another aid directed at the leisure niche of golfers.

Figure 1:
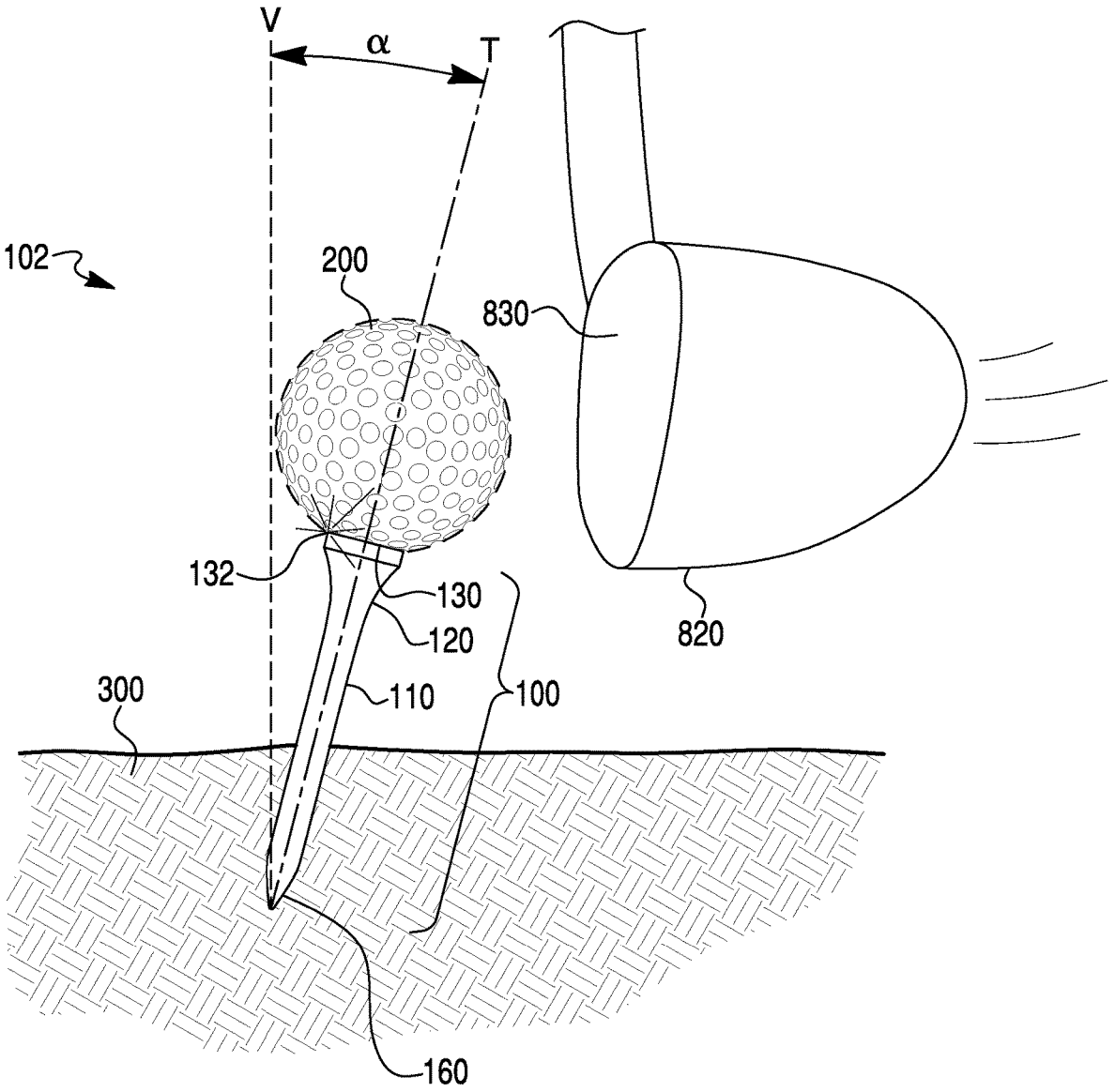
FIG. 1 (Prior Art)
FIG. 1 is a side view of a golf tee arrangement of an earlier golf tee when said earlier golf tee forms an angle with the vertical.

Furthermore, since golf ball 200 contacts tee 400 of FIG. 5 over a smaller area than golf ball 200 contacts tee 100 of FIG. 1, less friction and resistance is present between golf ball 200 and tee 400 than between golf ball 200 and tee 100. As a result, the golfer can hit the ball farther, or deliver more spin to the golf ball 200 because a more efficient transfer of energy from club 800 to ball 200 can be realized than when tee 100 of FIG. 1 is used.

Figure 6A:
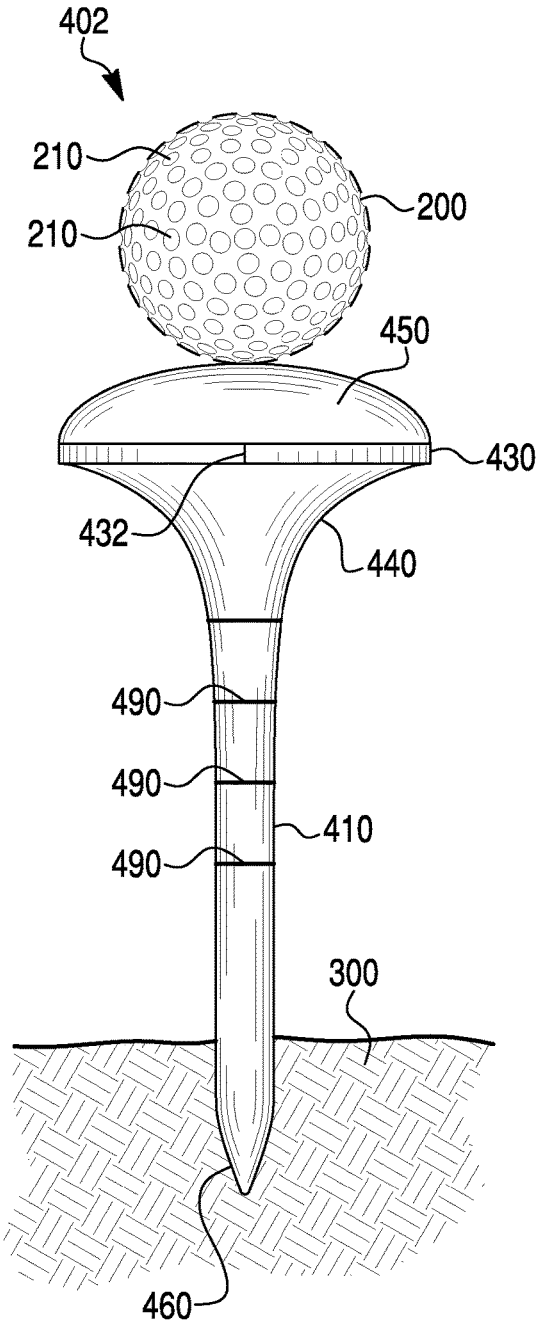
FIG. 6A is a front side view of a golf tee arrangement using the golf tee according to the first embodiment of the present invention.
Figure 6B:
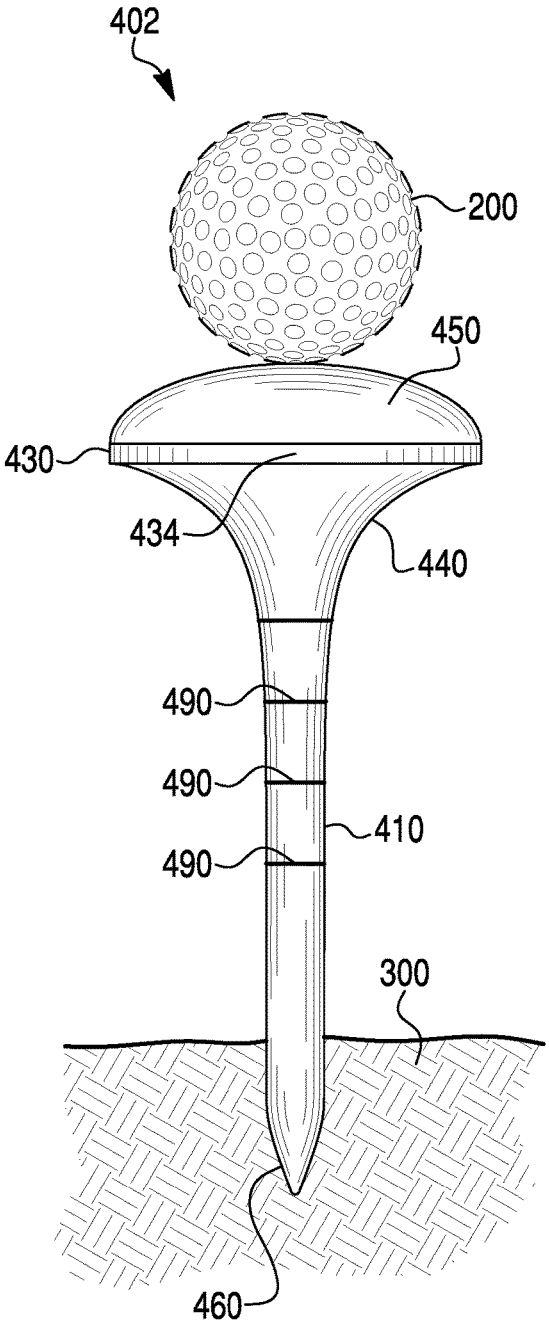
FIG. 6B is a rear side view of a golf tee arrangement using the golf tee according to the first embodiment of the present invention.

Turning now to FIGS. 6A and 6B, FIGS. 6A and 6B illustrate front and back views respectively of golf tee arrangement 402 according to the first embodiment of the present invention. FIGS. 6A and 6B are analogous to that of FIGS. 3A and 3B respectively except that golf ball 200 is arranged on top convex surface 450 and tip 460 of tee 400 is inserted into ground 300.

In order to stably arrange golf ball 200 on top of convex surface 450, stem portion 410 is inserted into ground such that that the stem portion 410 extends essentially vertical V, parallel to the direction of gravity, or is horizontal or leveled with Earth's surface, and that axis T of tee 400 coincides with vertical V. Accordingly, dimples 210 of golf ball 200 allow golf ball 200 to be stably arranged at center point C on convex surface 450. If stem 410 of golf tee 400 were to be inserted into ground at an angle α with respect to vertical V, golf ball 200 would roll off of convex surface 450 of tee 400 as in FIG. 7. Therefore, the design of tee 400 of the present invention prevents the scenario of FIG. 1 from occurring where the stem is inserted into ground at an angle α with respect to vertical V while having golf ball 200 stably arranged thereon.

Furthermore, golf ball 200 contacts convex surface 450 of the tee over a surface area covered by no more than four dimples 210 on a golf ball, and since dimple 210 has a diameter from 0.15 inch to 0.17 inch, the area covered is smaller than the area covered by the 0.75 inch in diameter of top surface 150 of conventional tee 100 of FIG. 1. The small surface area or area of contact between ball 200 and convex surface 450 results in less friction between the golf ball 200 and tee 400 than between golf ball 200 and tee 100, such that more kinetic and rotational energy being delivered to golf ball 200 by the golf club, which is an advantage in golf as the golf player can hit the ball farther and/or provide better directional hooking than when using tee 100 of FIG. 1.

When the conventional golf tee 100 is inserted into the ground 300 at an angle α with the vertical V as in FIG. 1, the ball 200 remains on top surface 150 of tee 100 even when the tee axis T aberrates from vertical V by angle α. As a result, when the tee 100 of FIG. 1 is inserted into ground 300 at angle α, the golf player must adopt differing postures and golf swings depending on the angle α in order to hit the golf ball with a golf club. The present invention has overcome this problem by forming a non-adhesive top surface 450 of golf tee 400 to be convex instead of being concave, so that there is less friction between tee 400 and ball 200 to allow more kinetic and rotational energy to be transferred to ball 200 by club, and to prevent the golfer from using the tee 400 to support ball 200 when the stem 410 is inserted into ground 300 at a substantial angle α with respect to vertical V as in FIG. 1. As a result, a more consistent posture and swing can be realized, and a longer shot and/or a greater spin can be achieved.

The golf ball 200 includes a plurality of dimples 210 throughout an outer surface thereof, these dimples 210 allow the golf ball 200 to be stably arranged on top convex surface 450 of tee 400, such that ball 200 will not slide off tee 400 when the stem 410 is inserted vertically into ground 300 as in FIG. 6, where the axis T of tee 400 coincides with the vertical axis V. As a result, the inventive golf tee 400 of the present invention prevents the golfer from having to adjust and vary his or her posture and swing according to the angle α that the golf tee is inserted into the ground. A more consistent posture and golf swing is therefore realized.

Figure 8A:
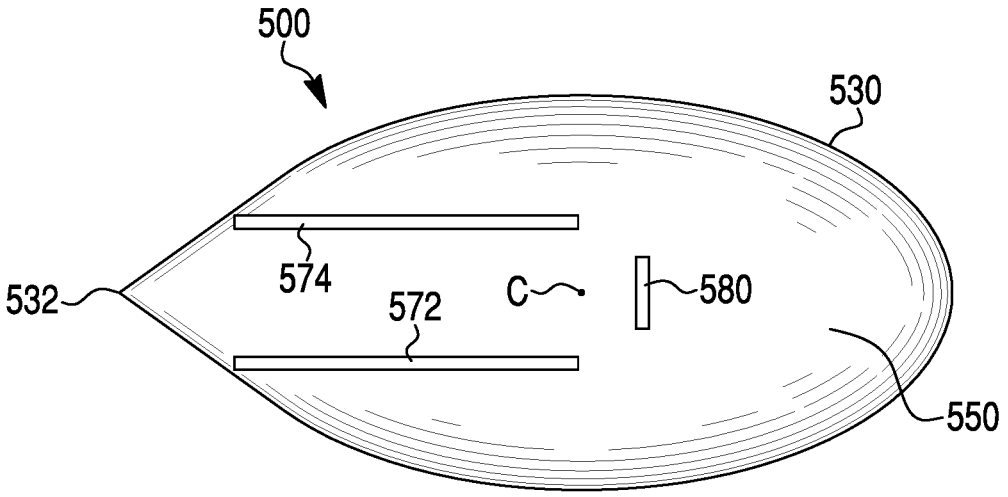
FIG. 8A is a top view of a golf tee according to a second embodiment of the present invention.
Figure 8B:
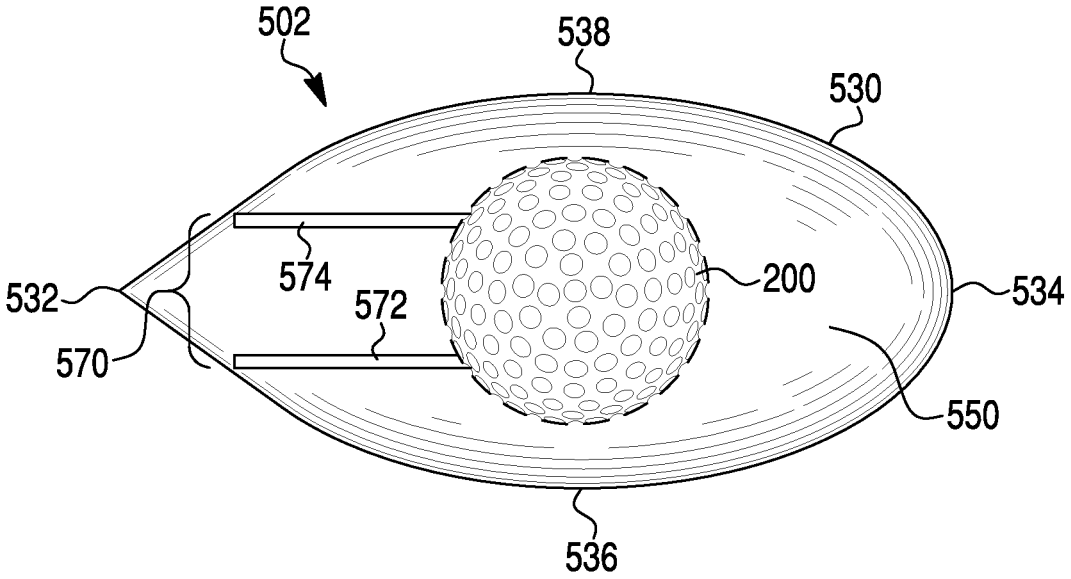
FIG. 8B is a top view of a golf tee arrangement using the golf tee of FIG. 8A according to the second embodiment of the present invention.
Figure 9A:
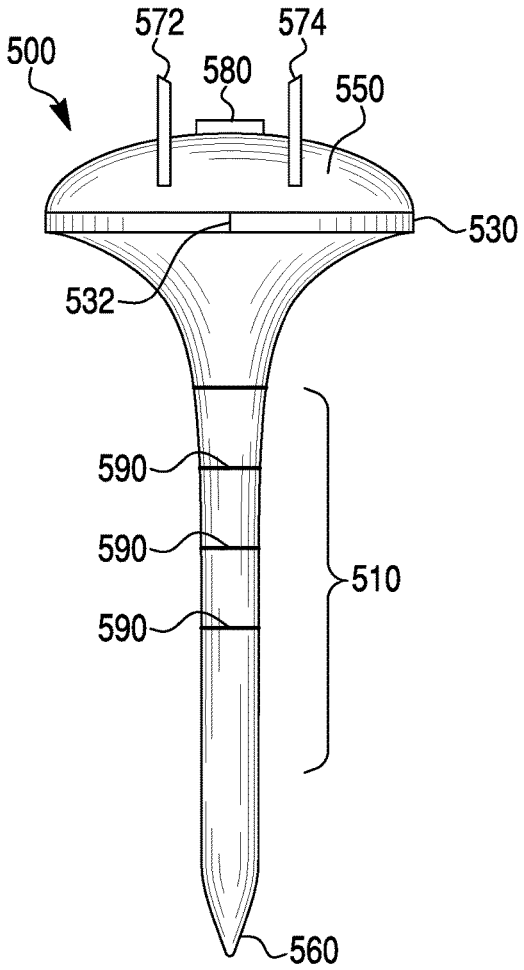
FIG. 9A is a front side view of the golf tee of FIG. 8A according to the second embodiment of the present invention.
Figure 9B:
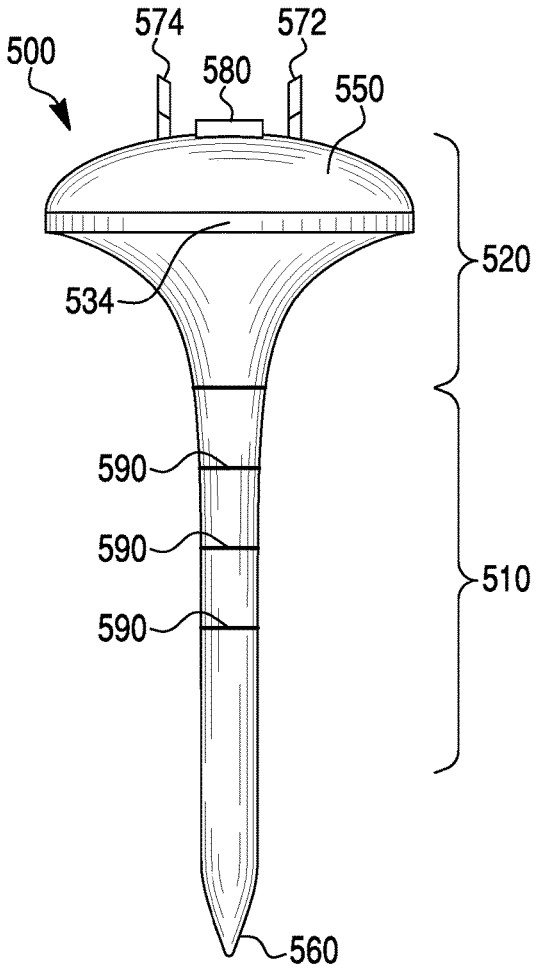
FIG. 9B is a rear side view of the golf tee of FIG. 8A according to the second embodiment of the present invention.
Figure 10:
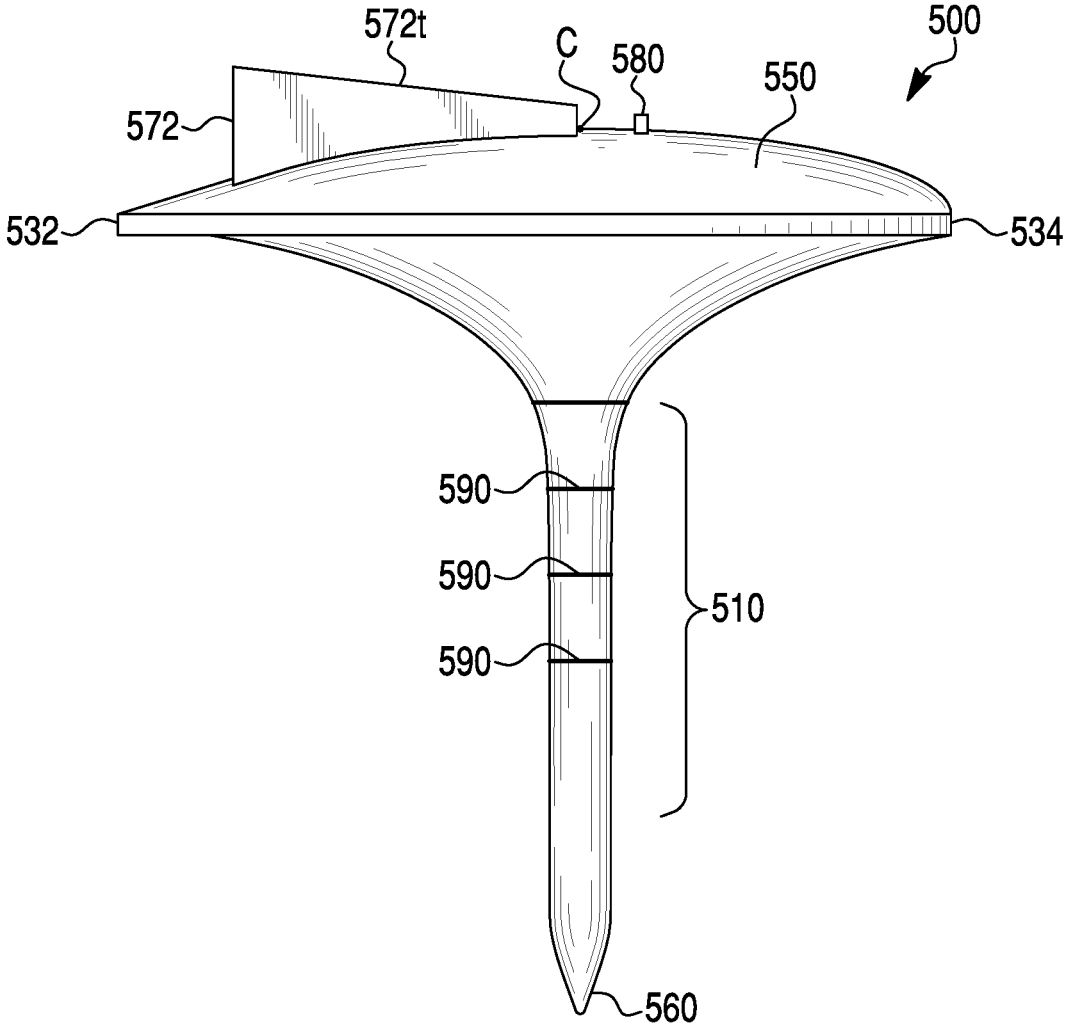
FIG. 10 is a left side view of the golf tee of FIG. 8A according to the second embodiment of the present invention.
Figure 11A:
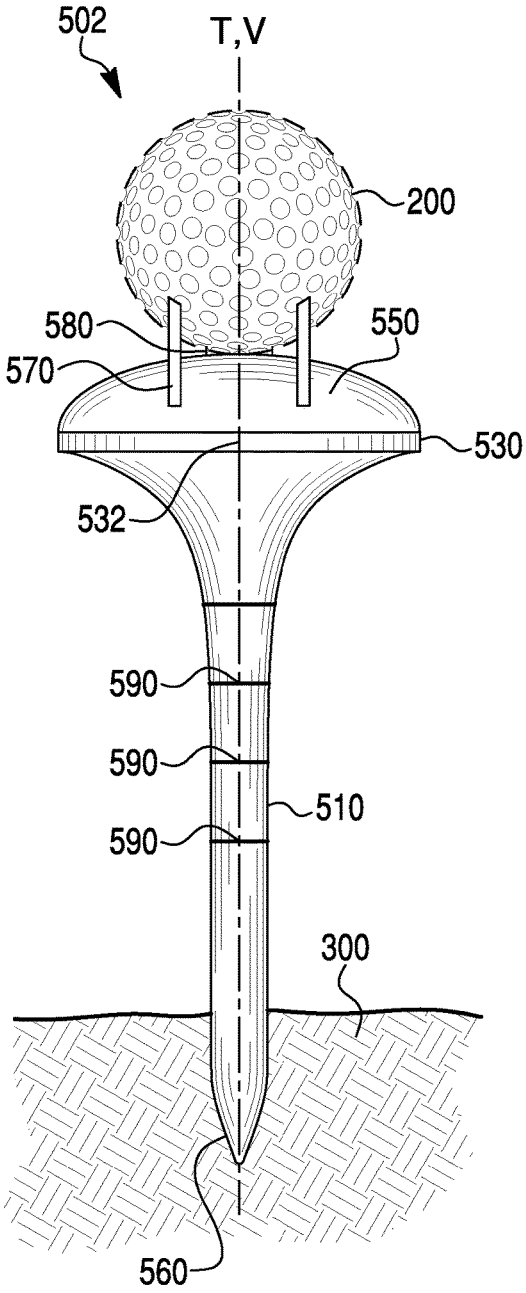
FIG. 11A is a front side view of a golf tee arrangement using the golf tee according to the second embodiment of the present invention.
Figure 11B:
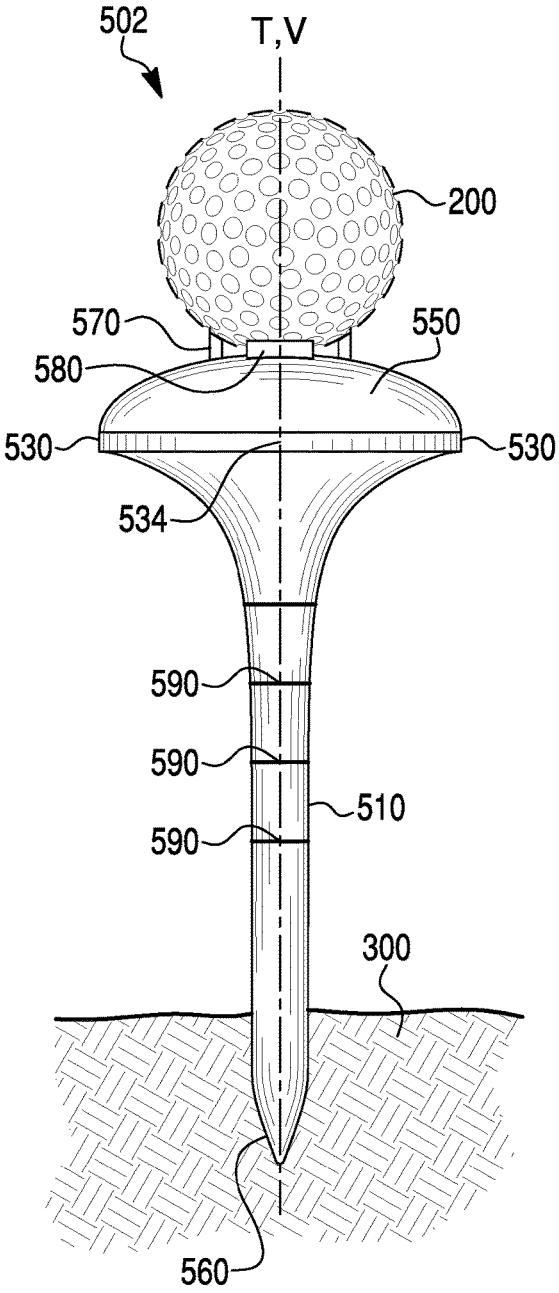
FIG. 11B is a rear side view of a golf tee arrangement using the golf tee according to the second embodiment of the present invention.
Figure 12:
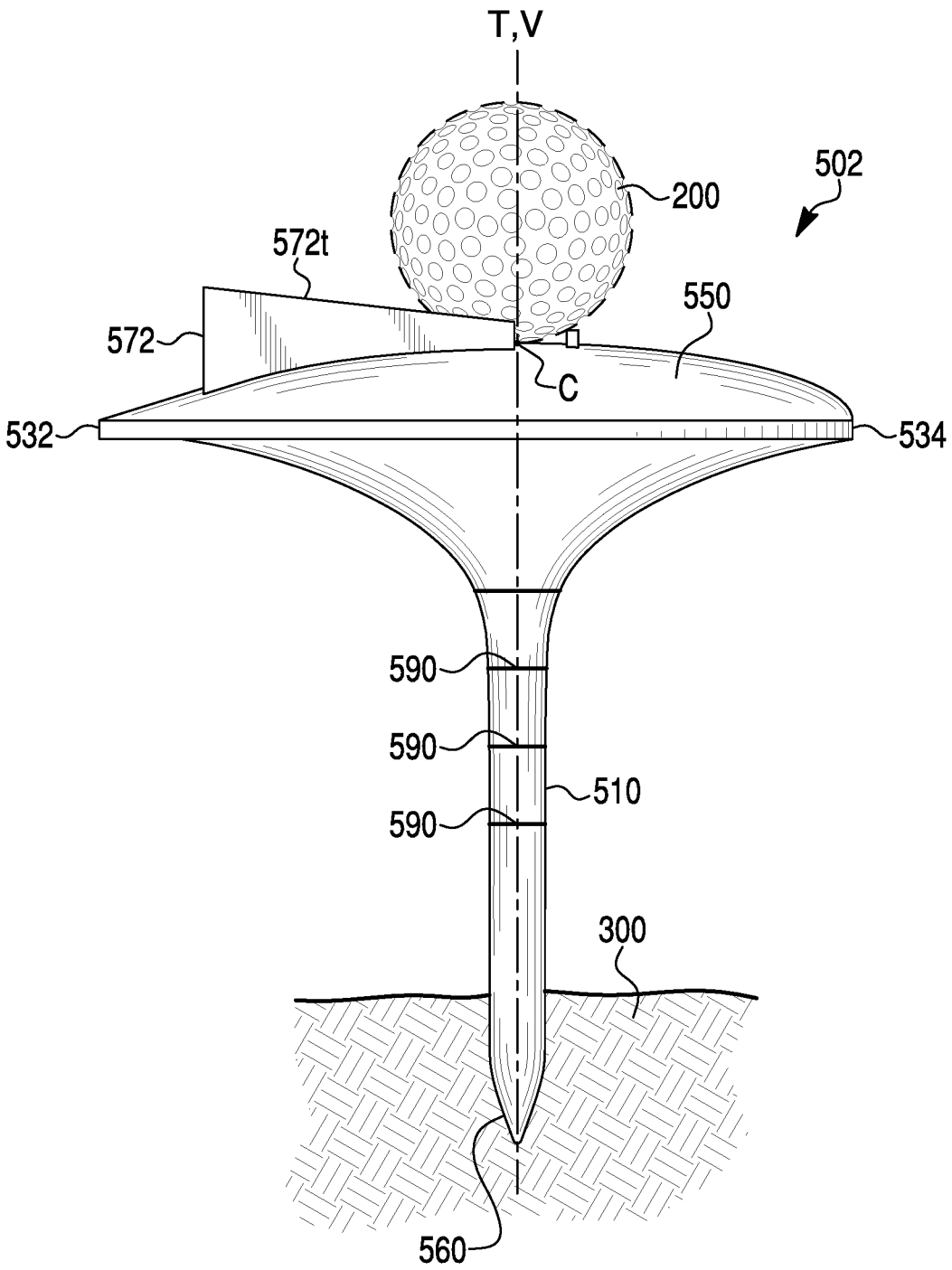
FIG. 12 is a left side view of a golf tee arrangement using the golf tee according to the second embodiment of the present invention.

FIGS. 8A to 12 illustrate a golf tee 500 and golf tee arrangement 502 according to a second embodiment of the present invention. Specifically, FIG. 8A is a top view of tee 500, FIG. 8B is a top view of tee arrangement 502, FIG. 9A is a front side view of tee 500, FIG. 9B is a back side view of tee 500, FIG. 10 is a left side view of tee 500, FIG. 11A is a front side view of tee arrangement 502, FIG. 11B is a back side view of tee arrangement 502, and FIG. 12 is a left side view of tee arrangement 502 according to the second embodiment of the present invention. FIGS. 11A, 11B and 12 correspond to FIGS. 9A, 9B and 10 respectively except that ball 200 is mounted on tee 500 and tee 500 is inserted into ground 300 as in FIGS. 11A to 12.

As illustrated in FIGS. 8A to 12, golf tee 500 includes a top convex surface 550. When viewed from the top, convex surface 550 has an elongation oval-like shape with contour or edge portion 530 at a periphery thereof. As with the tee 400 of the first embodiment of FIGS. 2-7, when tip 560 of stem 510 of tee 500 is properly inserted into ground 300 such that the axis T of tee 500 coincides with the vertical V, or that the tee is leveling or horizontal with the Earth's surface, center point C of convex surface 550 corresponds to the apex of tee 500. Edge portion 530 includes a pointed front edge 532, a back edge 534 opposite front edge 532, and left and right edges 536 and 538 opposite each other, however the present invention is in no way so limited as it is possible for both front edge 532 and back edge 534 to be rounded.

Similar to the first embodiment of FIGS. 2-7, stem portion includes a plurality of equally spaced markings 590 thereon to allow the user to visualize the depth in which the stem portion 510 is inserted into ground. Unlike the first embodiment of the present invention of FIGS. 2A to 7, the novel tee 500 and golf tee arrangement 502 of the second embodiment further includes a pair of rails 570 and backstop 580 on convex surface 550.

In the second embodiment of FIGS. 8A to 12, first rail 572 and second rail 574 are arranged in parallel to each other. Rails 572 and 574 can be comprised of metal, plastic or any other suitable material. Furthermore, each of rails 572 and 574 extend from near center point or apex C to near front edge 532 and may include a slight incline in going from center point C to front edge 532 to provide more lift for the golf ball 200 when struck by a golf club. That is, top edges 572*t* and 574*t* of rails 572 and 574 respectively may be inclined with respect to the horizontal to provide for greater lift of ball 200. Rails 570 aid the leisure niche of golfers in providing more lift to golf ball 200.

The rails 570 extend from near center point C of convex surface 550 forward to close to front edge 532. The rails 570 are spaced apart from each other to allow golf ball to be arranged therebetween first rail 572 and second rail 574.

Likewise, backstop 580 can be comprised of metal, plastic, rubber or other suitable materials. Preferably, backstop 580 is detachable and attachable in a same manner as is the rails 570. As illustrated in FIGS. 8A, 10 and 12, backstop 580 is positioned slightly to the rear of a center point C on convex surface 550 to allow golf ball 200 to stably rest on center point C of convex upper surface 550. The purpose of the backstop 580 is to provide extra stability when positioning golf ball 200 on convex surface 550 and to guide ball 200 forward of center point C when struck by a golf club. The purpose of rails 570 is to guide the trajectory of golf ball 200 forward when struck by a golf club. As a result, tee 500 of the second embodiment of FIGS. 8A to 12 provides a placement support of golf ball 200 on convex surface 550 and provides a guided trajectory for the golf ball than golf tee 400 of the first embodiment of FIGS. 2 to 7. Accordingly, both the backstop 580 and rails 570 are removable and re-attachable.

Preferably, each of rails 572 and 574 may be removable from the convex surface 550 of tee 500. In other words, tee 500 is designed so that the golf player can remove each of rails 572 and 574 and backstop 580 from convex surface 550 and attach them back onto convex surface 550 when desired. Such fastening means can include interference fitting, camming, screwing, or any other fastening mechanism.

Figure 13:
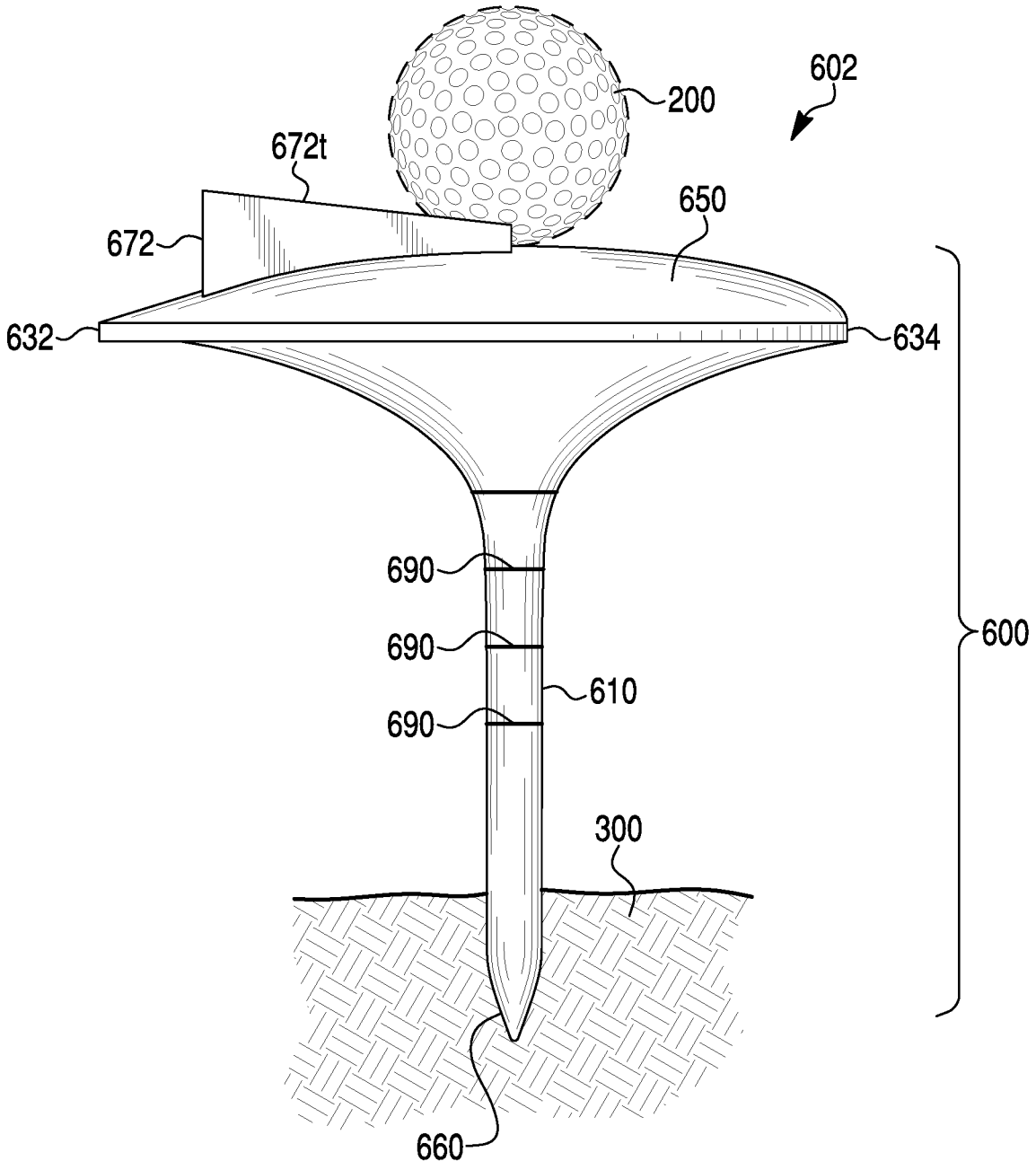
FIG. 13 is a left side view of a golf tee arrangement according to a third embodiment of the present invention.
Figure 14:
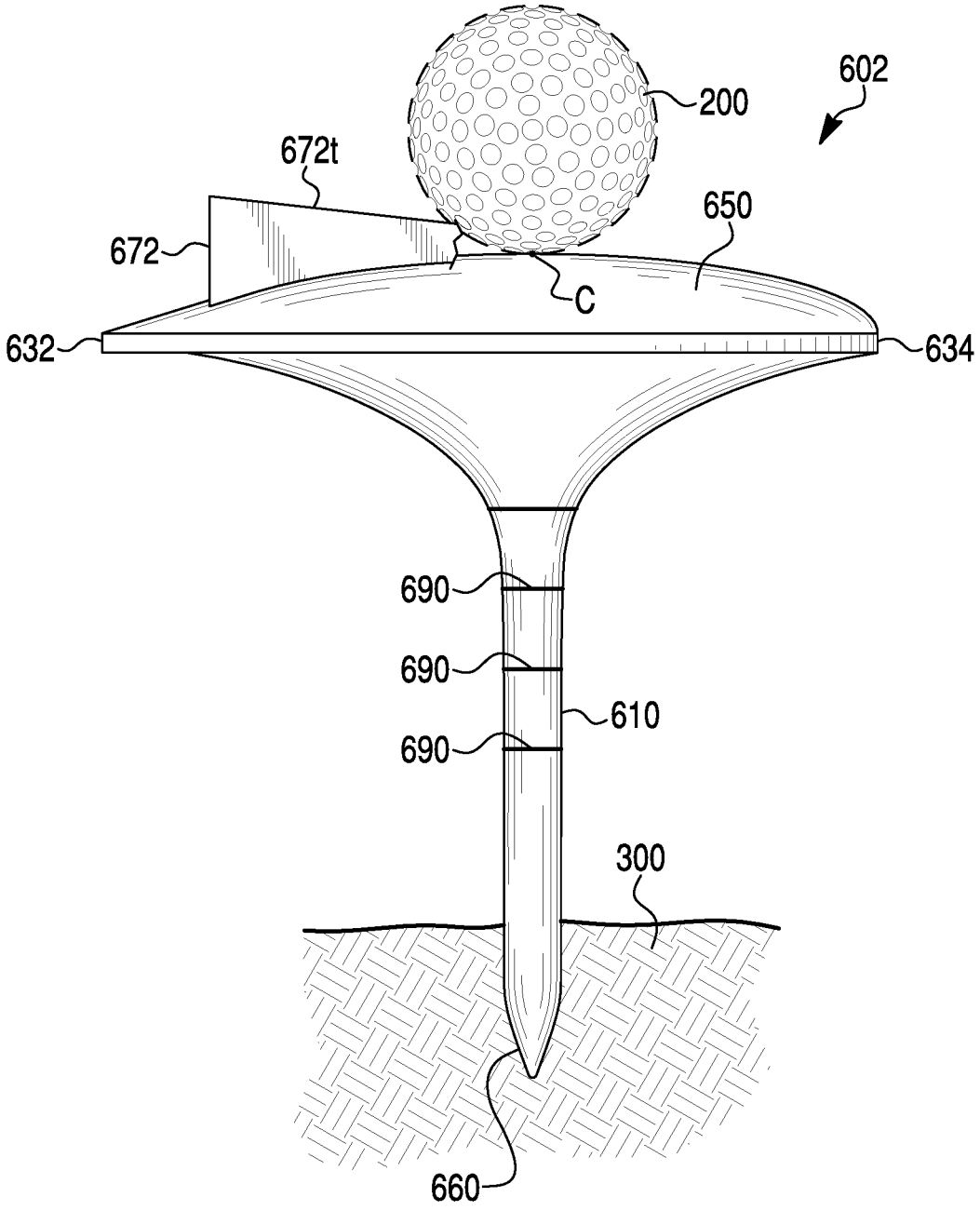
FIG. 14 is a cut out left side view of the golf tee arrangement of FIG. 13 according to the third embodiment of the present invention.
Figure 15:
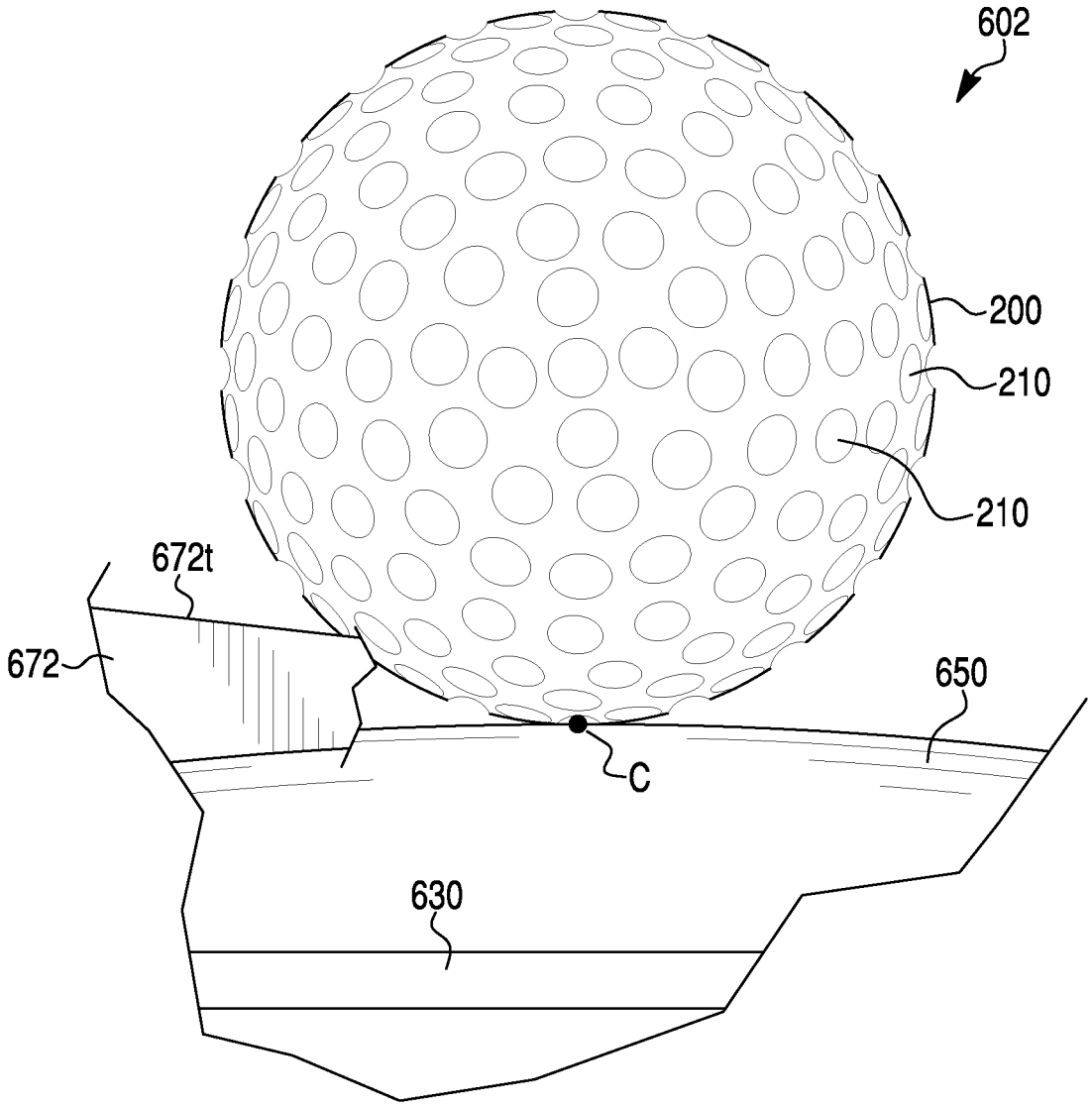
FIG. 15 is a close-up of a portion of the cut-out view of the golf tee arrangement of FIG. 14 according to the third embodiment of the present invention.

FIGS. 13 to 15 illustrate a golf tee 600 and golf tee arrangement 602 according to a third embodiment of the present invention. Specifically, FIG. 13 is a side view of golf tee arrangement 602, and FIGS. 14 and 15 are progressively close-up and cut-away views of the golf ball 200 at rest on center point C of convex surface 650. The cut-out views of FIGS. 14 and 15 shows the bottom of golf ball 200 resting on convex top surface 650 of tee 600.

The third embodiment is similar to that of the second embodiment of FIGS. 8A to 12 except that the backstop 580 of FIGS. 8A to 12 has been removed. As a result, golf ball 200 does not have the support of backstop 580 when the golf player places the golf ball 200 and convex surface 650. In such a scenario, the axis T of tee 600 coincides with the vertical V so that the tee 600 extends vertically, and that the ball 200 is placed at center point C of convex surface 650 in order for the golf ball 200 to rest stably on tee 600. As in the first embodiment of FIGS. 2 to 7, the dimples 210 in golf ball 200 allow the golf ball 200 to be stably placed on convex surface 650 in absent of any backstop or adhesive.

Figure 16:
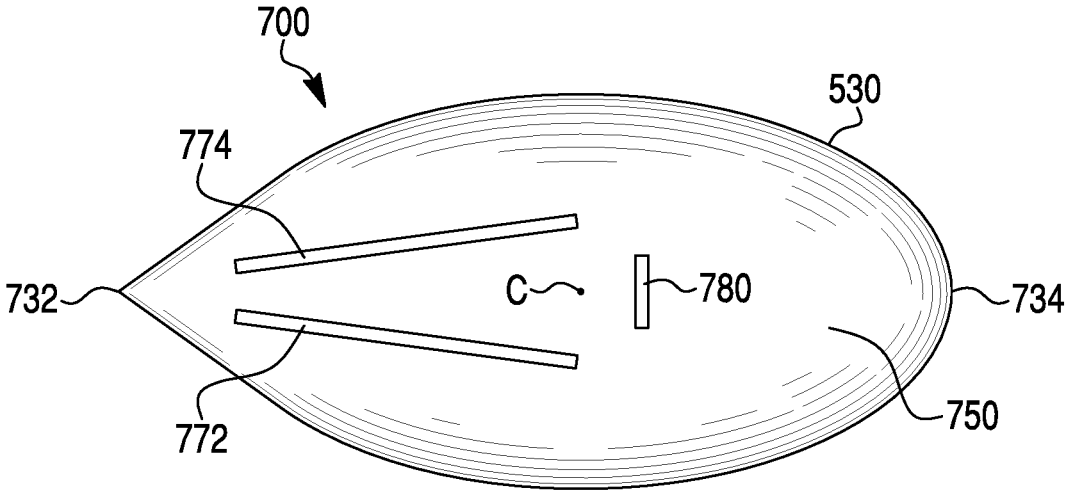
FIG. 16 is a top view of a golf tee according to a fourth embodiment of the present invention.

FIG. 16 illustrates a golf tee 700 according to a fourth embodiment of the present invention. The embodiment of FIG. 16 is similar to that of the second embodiment of FIGS. 8A to 12 except that the two rails 772 and 774 are not parallel to each other. In the embodiment of FIGS. 8A to 12, the rails 572 and 574 were parallel to each other. In the embodiment of FIG. 16, the rails 772 and 774 form a V-shape, and are closest to each other near front edge 732 and are farthest apart from each other near center point C on convex surface 750. The significance of forming the rails to have a V-shape is to provide a greater loft and lift for the golf ball 200 upon being struck by a golf club.

It is to be understood that other additional embodiments are possible and are still within the scope of the present invention. For example, features of different embodiments can be combined in various manners to produce additional embodiments. For example, a new embodiment can be formed whereby the rails form V-shaped as in FIG. 16, but the backstop is not present. Another embodiment is to have a backstop but no rails. Alternative embodiments may include forming a round front edge, forming a pointed back edge on the golf tee, having varying fasteners for the rails, having various inclination angles for the rails, having various curvatures of the convex surface, and various using various materials for the tee. Each of these modifications are within the scope of the present invention.

The invention claimed is:

1. A golf tee for supporting a golf ball above a ground, comprising:

a stem portion; and a top portion connected to the stem portion, the top portion including an upper surface opposing the stem portion, the upper surface is convex throughout the upper surface, the upper surface having a front edge that opposes a back edge, such that the front edge is spaced apart from the back edge by a length of the upper surface, the upper surface further including a convex center point at an apex of the upper convex surface, the convex center point is arranged between the front and back edges, such that the upper surface is free of an adhesive material or material that anchors the golf ball against uneven ground, wherein the stem portion has a proximal end that is pointed and an opposite and a distal end that connects to the top portion; the top portion comprises an edge portion arranged between a lower surface and the upper surface, the top portion having a length and a width, wherein the length is at least 1.5 times the width; and the golf tee further comprising a pair of rails arranged on the upper surface of the top portion, wherein the rails extend in a direction parallel to the length of the upper surface, and are arranged in between the convex center point and the front edge and extend from near the convex center point to near the front edge, such that when the stem portion is inserted into the ground in a vertical manner aligned with gravity or is horizontal to the Earth's surface, the golf ball stably rests on the convex center point of the upper surface.

2. The golf tee of claim 1, the stem portion and the top portion being a single integrated monolithic unit.

3. The golf tee of claim 1, wherein the width of the top portion is greater than the diameter of the golf ball and is no more than 3 inches.

4. The golf tee of claim 1, the rails being parallel to each other.

5. The golf tee of claim 3, the rails converging towards the front edge.

6. The golf tee of claim 4, wherein the rails are removable from the upper surface of the top portion by interference fit, camming or a screw and bolt combination.

7. The golf tee of claim 1, further comprising a backstop arranged on the upper surface of the top portion and away from the convex center point of the top convex surface by a distance that is less than a radius of the golf ball.

8. The golf tee of claim 7, wherein the backstop is parallel to the width of the upper surface and is orthogonal to a pair rails arranged on the upper surface of the top portion.

9. The golf tee of claim 1, wherein a portion of the upper surface about the convex center point is horizontal with gravity, when the stem is inserted into the ground in a vertical manner.

10. The golf tee of claim 1, the stem portion including a plurality of markings between the proximal and the distal ends.

11. The golf tee of claim 1, wherein the rails are inclined with respected to a horizontal in going from the convex center point to the front edge when the stem extends in a vertical manner parallel to gravity.

12. A method of using a golf tee, comprising:

1) providing the golf tee that includes a) a stem portion having a pointed proximal end and a distal end opposing the proximal end; and b) a top portion including an upper surface that faces away from the stem, the distal end of the stem portion is attached to the top portion, the upper surface is convex throughout and has a convex center point at an apex, the upper surface is free of adhesive or material that anchors the golf ball against an uneven ground wherein the golf tee further comprising a pair of rails extending from near the center point to near the front edge of the upper surface, the golf ball being guided by the rails after the head contacts the ball;

2) inserting the proximal end of the stem into the ground;

3) placing a golf ball on the convex center point of the convex upper surface; and 4) readjusting an angle of the stem with vertical, such that the convex center point is horizontal to the Earth's surface, to enable the golf ball to stay on the convex center point of the convex upper surface.

13. The method of claim 12, further comprising striking the golf ball by swinging a golf club having a head at the golf ball arranged on the upper convex surface of the tee, the head moving from a back end to a front end of the convex upper surface.

14. The method of claim 12, wherein the stem portion comprises a plurality of markings that circumvent an outer surface of the stem portion, wherein the inserting comprises referring to the markings to determine the depth into the ground the stem portion has been inserted.

15. The method of claim 12, further comprising attaching a pair of rails and a backstop to the top surface of the tee prior to step 2).

16. The method of claim 12, further comprising attaching a pair of rails to the top surface of the tee prior to step 2).

* * * * *